US007356876B2

(12) United States Patent
Dant et al.

(10) Patent No.: US 7,356,876 B2
(45) Date of Patent: Apr. 15, 2008

(54) SWIVEL ASSEMBLY FOR CONNECTING A WAND TO A NOZZLE ASSEMBLY OF A VACUUM CLEANER

(75) Inventors: Ryan T. Dant, Lexington, KY (US); Richard E. Downey, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 0 days.

(21) Appl. No.: 11/494,256

(22) Filed: Jul. 27, 2006

(65) Prior Publication Data

US 2008/0022488 A1 Jan. 31, 2008

(51) Int. Cl.
*A47L 9/02* (2006.01)
*A47L 9/24* (2006.01)

(52) U.S. Cl. ..... 15/414; 15/415.1; 285/7

(58) Field of Classification Search ..... 15/414, 15/415.1; 403/78, 164; 285/7
See application file for complete search history.

(56) References Cited

U.S. PATENT DOCUMENTS

| | | | | |
|---|---|---|---|---|
| 2,122,633 | A * | 7/1938 | Baxter | 285/7 |
| 2,262,585 | A * | 11/1941 | Irmischer | 285/181 |
| 3,159,412 | A | 12/1964 | Descarries | |
| 3,203,023 | A * | 8/1965 | Jepson et al. | 15/371 |
| 3,565,464 | A | 2/1971 | Wolf | |
| 4,094,535 | A | 6/1978 | Minton | |
| 4,105,346 | A | 8/1978 | Gelinas | |
| 4,557,535 | A | 12/1985 | Keane | |
| 4,700,429 | A | 10/1987 | Martin et al. | |
| 4,940,415 | A | 7/1990 | Westergren | |
| 5,039,133 | A * | 8/1991 | Albrecht | 285/7 |
| 5,417,511 | A | 5/1995 | Warden | |
| 5,685,044 | A * | 11/1997 | Lavis et al. | 15/415.1 |
| 5,967,563 | A * | 10/1999 | Lavis et al. | 285/7 |
| 6,055,703 | A * | 5/2000 | Redding et al. | 15/411 |
| 6,889,917 | B2 | 5/2005 | Fahy et al. | |
| 7,108,293 | B2 * | 9/2006 | Van Der Meijden et al. | 285/275 |
| 2005/0120513 | A1 * | 6/2005 | Lee | 15/415.1 |

* cited by examiner

*Primary Examiner*—David B Thomas
(74) *Attorney, Agent, or Firm*—King & Schickli, PLLC

(57) ABSTRACT

In one aspect, a swivel assembly connects a wand to a nozzle assembly of a vacuum cleaner. The assembly includes a connector for pivotally connecting to the nozzle assembly and having an oversized opening formed in an outer sidewall thereof. A receiver is provided for receiving the wand at a first end and for connecting with the connector at the second end. A locking clip includes a lug movably received in the opening formed in the sidewall of the connector. Consequently, movement of the lug within the opening permits limited rotation of the receiver relative to the connector while restraining separation of the receiver from the connector. A related method of connecting a wand to a nozzle assembly is also described.

23 Claims, 5 Drawing Sheets

SWIVEL ASSEMBLY FOR CONNECTING A WAND TO A NOZZLE ASSEMBLY OF A VACUUM CLEANER

TECHNICAL FIELD

The present invention relates generally to the floor care equipment field and, more particularly, to a swivel assembly for connecting a wand to a nozzle assembly of a vacuum cleaner.

BACKGROUND OF THE INVENTION

Vacuum cleaners and, in particular, those of the canister type typically include a nozzle assembly for coupling with a wand that, in turn, connects to the canister. Since it is advantageous to manipulate the wand relative to the nozzle assembly for various reasons, many in the art have proposed different types of specialized connectors for this purpose. An example of one such arrangement is found in U.S. Pat. No. 4,700,429 to Martin et al., which shows a swivel-type connector for enabling rotational movement of a handle associated with the wand.

While the arrangement shown in the '429 patent does indeed permit the desired rotational movement, it is not without limitations. For one, the swivel connector itself includes the electrical coupling for the wand and, thus, requires a tubular piece intermediate the wand and the swivel connector to provide the desired ability to rotate. This type of arrangement also includes many parts to achieve the coupling, and thus would be not only complicated to use, but also expensive to produce and maintain.

Accordingly, a need is identified for an improved swivel assembly for connecting a wand to a nozzle assembly of a vacuum cleaner. The assembly would couple the nozzle assembly with the wand using a minimum number of parts, but without in any way sacrificing the security of the connection or foreclosing the desired relative rotation. The assembly would also be relatively easy and inexpensive to manufacture, requiring a minimum amount of assembly time and effort. Overall, the swivel assembly would be a significant improvement over the complicated and less reliable designs of the prior art.

SUMMARY OF THE INVENTION

In accordance with one aspect of the invention, a swivel assembly for connecting a wand to a nozzle assembly of a vacuum cleaner is disclosed. The assembly comprises a connector for pivotally connecting to the nozzle assembly and including an oversized opening formed in an outer sidewall thereof. A receiver is provided for receiving the wand at a first end and for connecting with the connector at a second end. A locking clip connects to the receiver and includes a lug movably received in the opening. As a result, movement of the lug within the opening permits the receiver to rotate relative to the connector while restraining separation of the receiver from the connector.

In one embodiment, the first end of the connector surrounds a portion of the receiver, and the opening comprises an arcuate slot. The connector further includes a channel generally opposite the opening, and the receiver includes a lug for positioning in the channel. Limited movement of the lug within the channel also restrains to a certain extent the relative rotational movement between the two structures.

The receiver preferably includes a groove for receiving the locking clip. This groove includes a rib and a pair of mounting shoulders, one on either side of the rib. The locking clip also includes a notch for receiving the rib, as well as resilient tabs for engaging the mounting shoulders. Together, these structures prevent the locking clip from rotating relative to the receiver in the mounted condition.

In accordance with another aspect of the invention, a swivel assembly for connecting a wand to a nozzle assembly of a vacuum cleaner is disclosed. The swivel connector in this aspect comprises a tubular connector for pivotally connecting to the nozzle assembly. The connector includes a slot formed in an outer sidewall thereof and a channel generally opposite the slot. A tubular receiver is provided for receiving the wand and includes a first lug movably received within the channel. A locking clip includes a second lug movably received in the slot. As a result, movement of the first lug within the channel and the second lug within the slot permits limited rotation of the receiver relative to the connector while restraining separation of the receiver from the connector.

In one embodiment, the slot and channel are arcuate and have generally matching degrees of curvature. The receiver may further include a groove for receiving the locking clip. Preferably, the groove includes a rib and a pair of mounting shoulders, one on either side of the rib, and the locking clip includes a notch for receiving the rib. The locking clip may further include resilient tabs for engaging the mounting shoulders.

In accordance with yet another aspect of the invention, a swivel assembly for connecting a wand to a nozzle assembly of a vacuum cleaner is disclosed. The assembly comprises a tubular connector for connecting to the nozzle assembly and including a slot formed in an outer sidewall thereof. A locking clip includes a lug movably received in the slot. A tubular receiver is also provided for receiving the wand and including a groove for receiving the locking clip. Movement of the lug within the slot permits limited rotation of the receiver relative to the connector while the locking clip when positioned in the groove resists separation of the receiver from the connector.

In one embodiment, the tubular connector includes a transverse head for creating a pivot point for pivotally connecting to the nozzle assembly. Preferably, the groove of the receiver includes a rib and a pair of mounting shoulders, one on either side of the rib. The locking clip includes a notch for receiving the rib, as well as resilient tabs for engaging the mounting shoulders.

In accordance with still another aspect of the invention, a method of connecting a wand to a nozzle assembly of a vacuum cleaner is described. The method comprises the steps of pivotally connecting a connector including an oversized opening formed in an outer sidewall thereof to the nozzle assembly, as well as connecting the wand at a first end of a receiver. The connector is connected to a second end of the receiver. The method further includes the step of associating a locking clip with the assembled connector and receiver (preferably by inserting it through the opening). The locking clip includes a lug movably received in the oversized opening formed in the connector. Consequently, movement of the lug within the oversized opening permits limited rotation of the receiver relative to the connector while restraining separation of the receiver from the connector. The method may further include inserting a lug or the receiver in a channel formed in the connector.

BRIEF DESCRIPTION OF THE DRAWING

The accompanying drawing incorporated in and forming a part of the specification, illustrates several aspects of the present invention and together with the description serves to explain certain principles of the invention. In the drawing.

Reference will now be made in detail to the present preferred embodiment of the invention, an example of which is illustrated in the accompanying drawings.

DETAILED DESCRIPTION OF THE INVENTION

Figure 1:
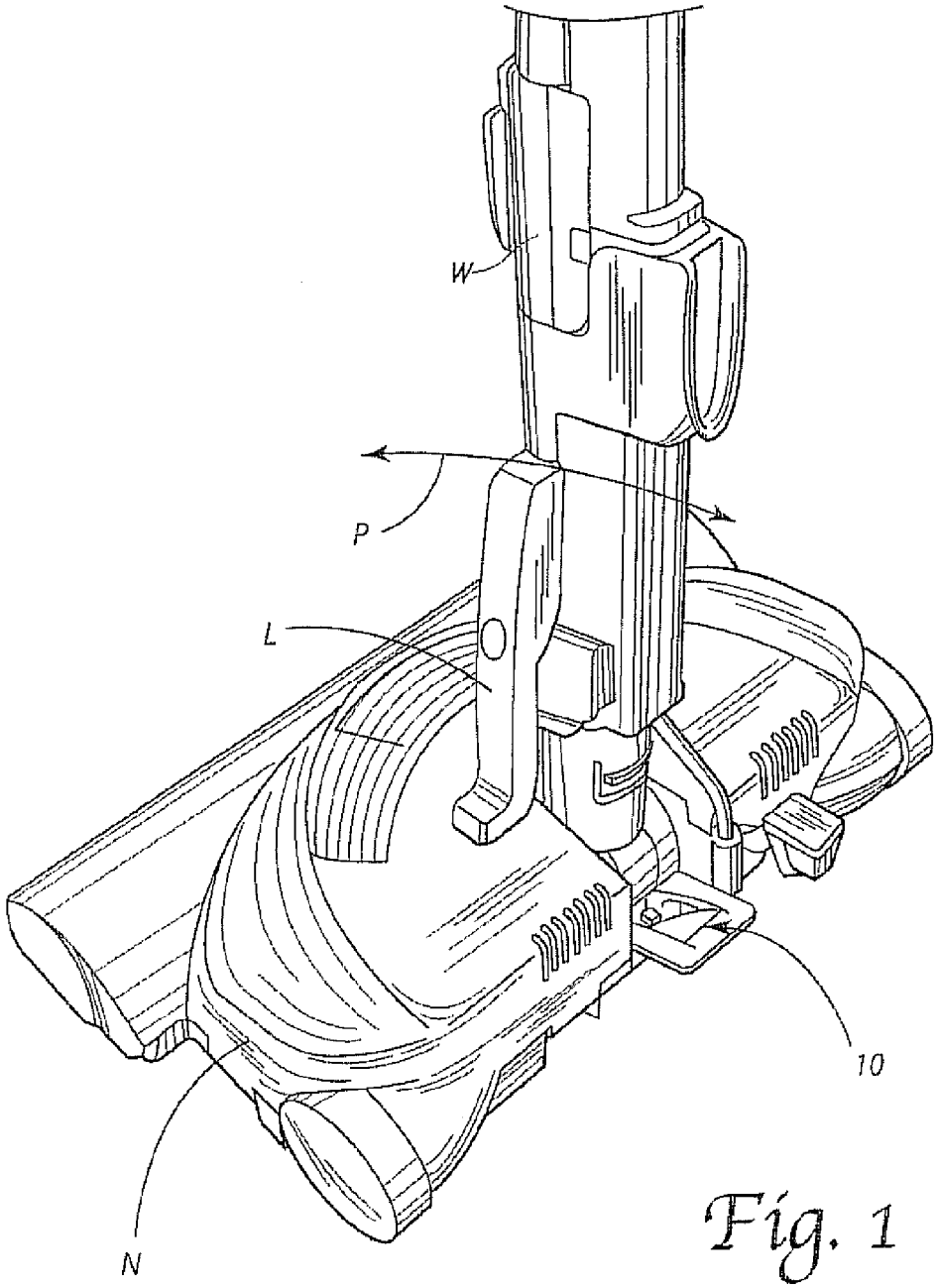
FIG. 1 is an overall perspective view of part of a vacuum cleaner, including the nozzle assembly and wand with which the swivel assembly forming one aspect of the invention may have utility.

Reference is now made to FIG. 1 showing a partial view of one possible type of vacuum cleaner with which the swivel assembly 10 of present invention may have utility. The vacuum cleaner includes a nozzle assembly, generally designated by reference character N, adapted for engaging and being moved along a surface to be cleaned, such as the floor. The nozzle assembly N via the swivel assembly 10 connects with a wand W, which in turn connects via a hose (not shown) to a canister (not shown) including a suction generator. The suction generated thus travels through the wand W and swivel assembly 10 to the nozzle assembly N to lift dirt and dust from the adjacent surface.

To drive an agitator associated with the nozzle assembly N, the swivel assembly 10 may optionally provide power to an associated motor (not shown), such as through a connector for interfacing with the wand W. The necessary power may be delivered from the canister through the wand W to the nozzle assembly N via a cable (not shown) attached at one end to the swivel assembly 10 and, in particular, to the receiver 14 (which may include an electrical socket for coupling with corresponding prongs on the wand W). However, this arrangement is considered entirely optional.

Figure 2:
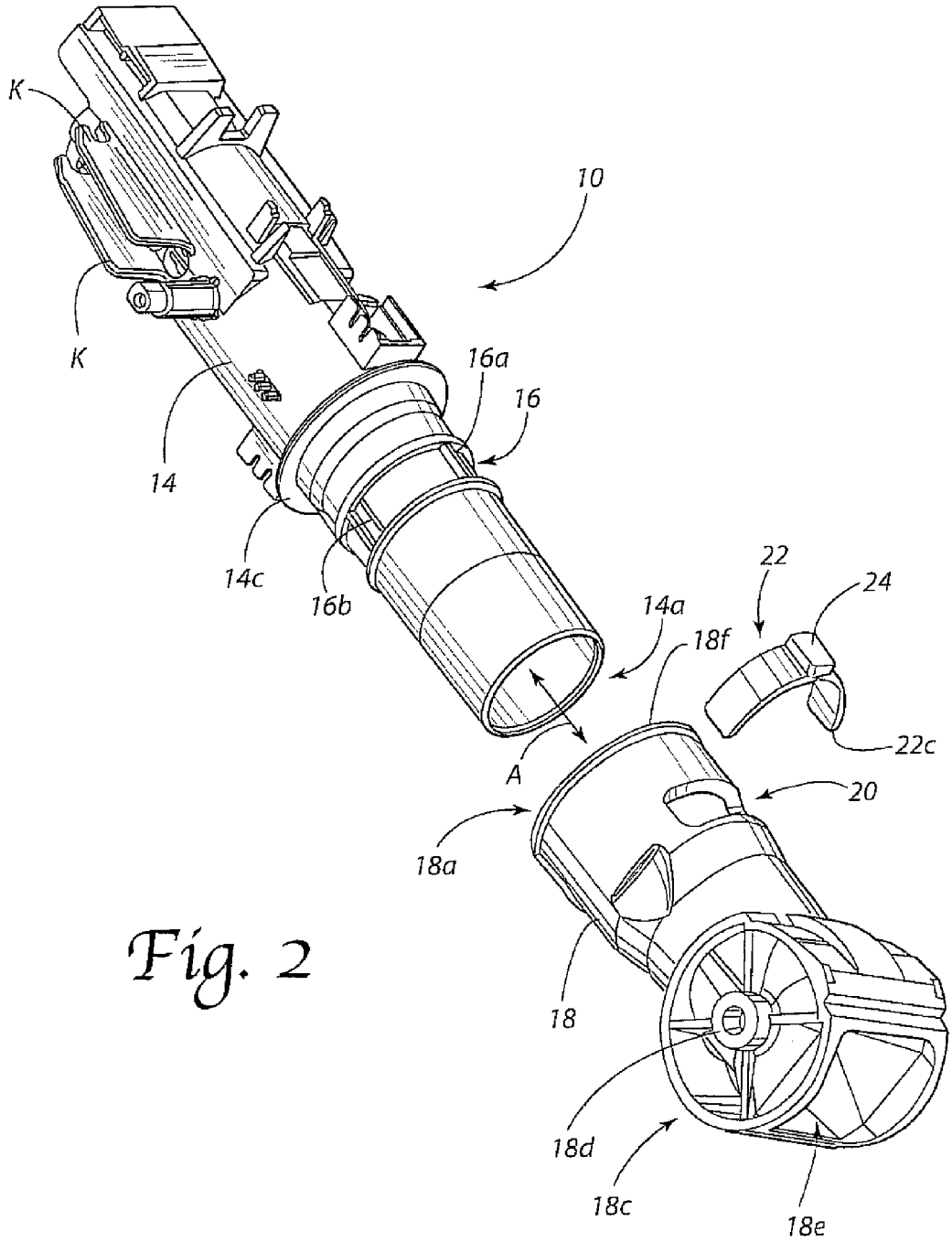
FIG. 2 is an exploded view of the swivel assembly forming one aspect of the present invention.

Turning now to the exploded view of FIG. 2, the swivel assembly 10 in the most preferred embodiment comprises three distinct parts adapted to interface and provide the desired secure connection with relative movement between the nozzle assembly N and the wand W. The first part for interfacing with one end with the wand W is a tubular receiver 14, which in the illustrated embodiment includes a male end 14*a* and a circumferential groove 16 formed just upstream thereof. The second part is a connector 18 having a distal end arranged for being pivotally mounted to the nozzle assembly 12. This connector 18 includes a female end 18*a* adapted to receive the male end 14*a* of the receiver 14 (note action arrow A), as well as an opening in the form of a slot 20 formed in an outer wall thereof. Interconnecting these two structures is a locking clip 22, which forms the third part of the swivel assembly 10. As outlined in further detail in the description that follows, the locking clip 22 attaches to the receiver 14 and semi-permanently couples it to the connector 18 while permitting the two to rotate freely relative to each other to at least a limited extent.

Figure 3:
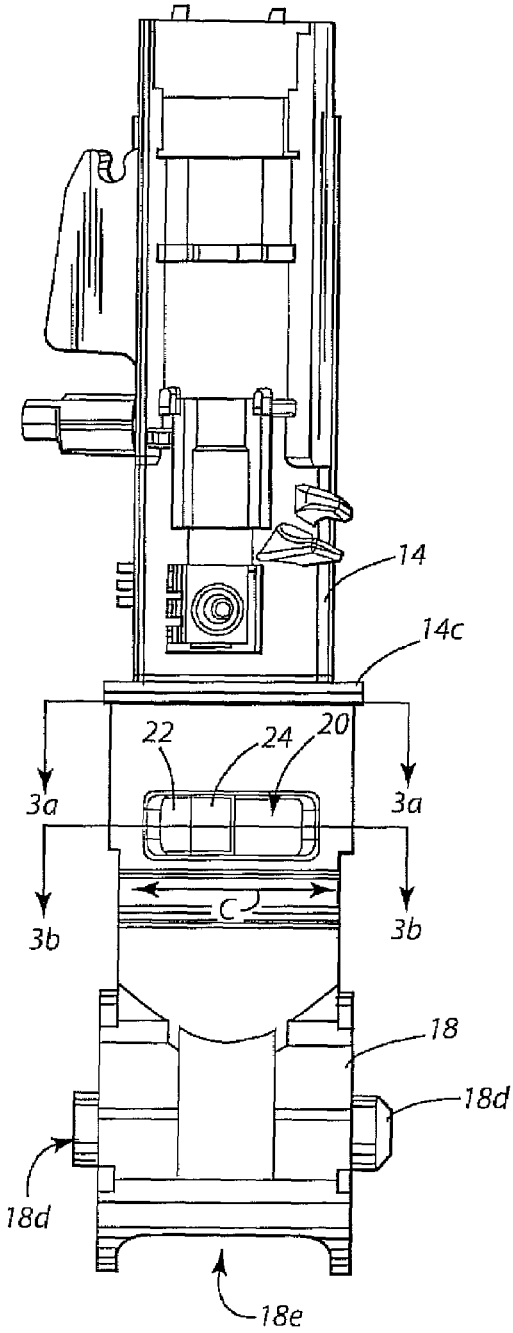
FIG. 3 is a front elevational view of the assembled swivel assembly of FIG. 2.
Figure 3A:
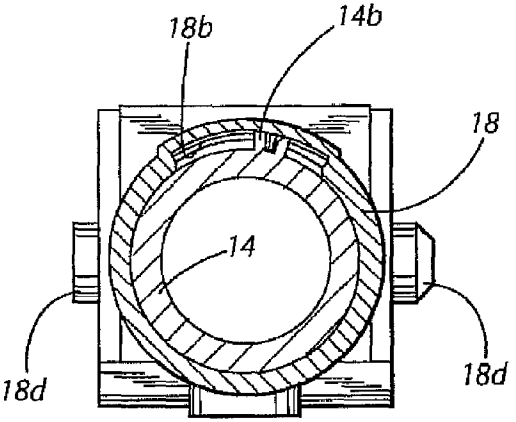
FIG. 3*a* is a cross-sectional view taken along line 3*a*-3*a* of FIG. 3.

Turning first to the tubular receiver 14 and, in particular, the groove 16, it includes a center rib 16*a*. The groove 16 further comprises a pair of mounting shoulders 16*b*, 16*c*, one positioned on either side of the rib 16*a* and preferably evenly spaced therefrom (see FIG. 3*a*). Aside from the groove 16, the receiver 14 also includes a projecting lug 14*b*, which is illustrated as being positioned generally opposite the center rib 16*a* and extending in a generally longitudinal direction. As perhaps best understood with combined reference to FIGS. 3, 3*a*, and 3*b*, the lug 14*b* and center rib 16*a* are spaced apart in the longitudinal direction of the receiver 14, as well as in the circumferential direction. The receiver 14 may also include various external brackets K, including for supporting a pivotally mounted latch L for engaging and locking the wand W in place (see FIG. 1) such that any desired electrical connection may be maintained.

The swivel connector 18 and locking clip 22 are adapted for mating with the projecting lug 14*b* and groove 16, respectively. Taking first the swivel connector 18, and with reference again to FIG. 3*a*, it includes a channel 18*b* positioned generally opposite the slot 20. This channel 18*b* partially circumscribes the tubular female end 18*a* of the connector 18 for receiving the receiver 14, and thus is also generally arcuate in shape. Preferably, the channel 18*b* has a degree of curvature generally matching that of the slot 20, which is relatively easy to accomplish in the situation where the connector 18 is generally cylindrical. In the illustrated embodiment, the slot 20 extends in the circumferential direction approximately 90°, and the channel 18*b* about 70°. The channel 18*b* also extends in the longitudinal direction a distance exceeding the length of the lug 14*b* of the receiver 14, thus ensuring that it may be fully received therein. The distal end of the connector 18 also includes a generally transverse mounting head 18*c* for forming a pivot point with the nozzle assembly N, such that the wand W when connected may pivot or swivel (note action arrow P in FIG. 1). To achieve such a pivotal mounting, this head 18*c* may include a pair of opposed receivers 18*d* (only one shown in FIG. 2) for receiving mounting structures, such as opposed pivot pins (not shown) carried by the nozzle assembly N and projecting inwardly from a cavity formed therein. The end 18*e* of the connector 18 is also open to provide a path for the suction to reach the nozzle assembly N when the two structures are connected.

Figure 3B:
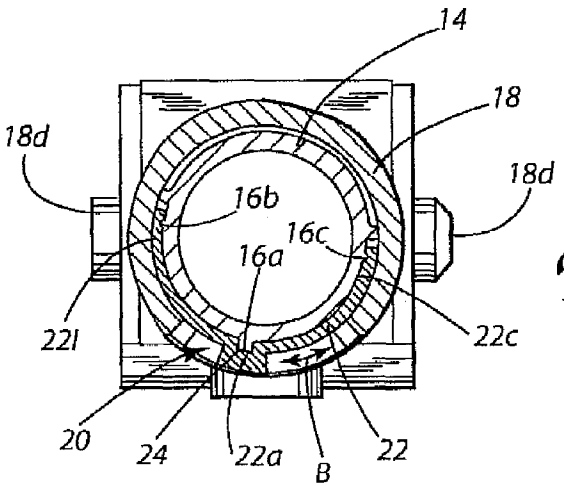
FIG. 3*b* is a cross-sectional view taken along line 3*b*-3*b* of FIG. 3.

With combined reference to FIGS. 2 and 3*b*, the locking clip 22 is generally arcuate or C-shaped for matching the outer surface of the receiver 14 in which the groove 16 is formed. To hold the locking clip 22 against rotational movement relative to the receiver 14 in the assembled condition, a notch 22*a* is provided for receiving the center rib 16*a*, and a pair of resilient tabs 22*b* 22*c*, engage the mounting shoulders 16*b*, 16*c*. Furthermore, the locking clip 22 includes a projecting lug 24 adapted for positioning within the slot 20. This projecting lug 24 is sized so as to occupy substantially the entirety of the slot 20 in the longitudinal direction. However, the slot 20 is oversized or elongated in the circumferential direction so as to permit movement of the lug 24 to and fro when positioned therein.

Figure 5:
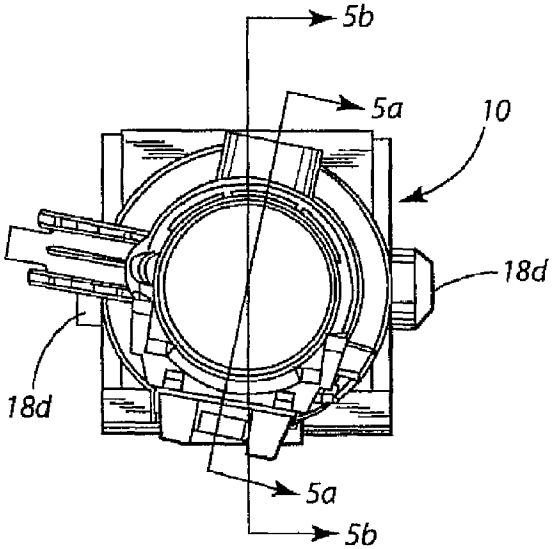
FIG. 5 is a top view of the assembled swivel assembly of FIG. 2.
Figure 5A:
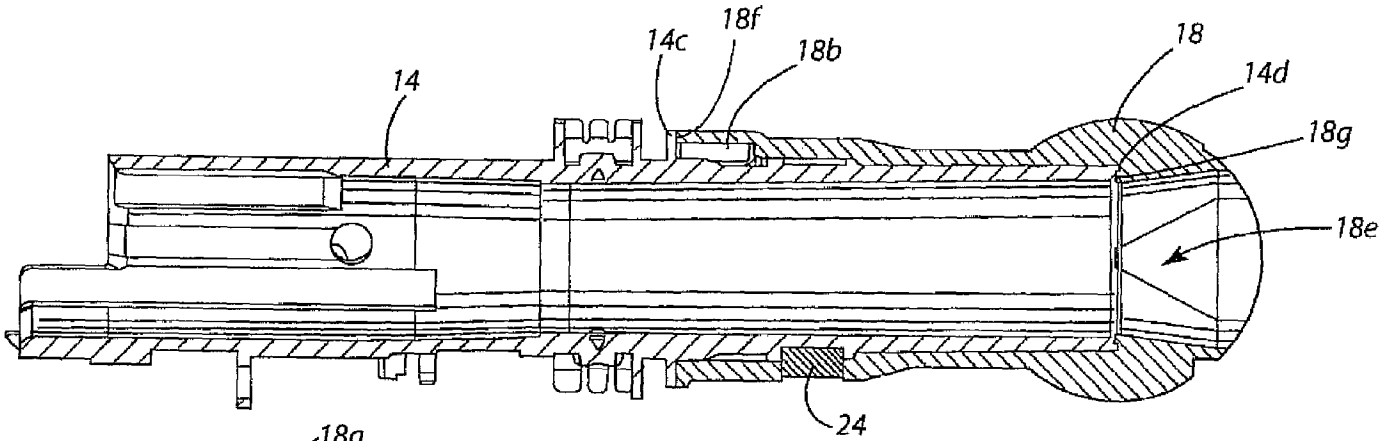
FIG. 5*a* is a cross-sectional view taken along line 5*a*-5*a* of FIG. 5.
Figure 5B:
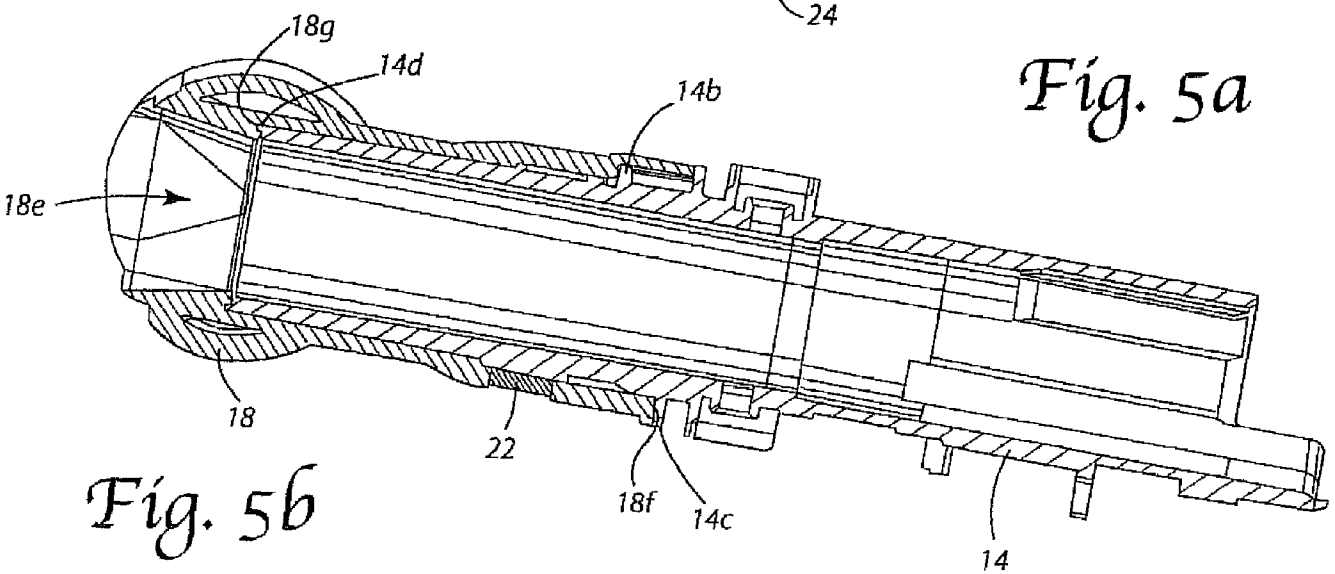
FIG. 5*b* is a cross-sectional view taken along line 5*b*-5*b* of FIG. 5.

Assembly of the components to create the swivel assembly 10 forming one aspect of the invention, and establish the desirable secure connection between the wand W and the nozzle assembly N with relative movement about at least two axes, may be accomplished in the following manner. The male end 14*a* of the receiver 14 is inserted in the female end 18*a* of the connector 18, with the lug 14*b* being positioned in the oversized channel 18*b*. Insertion is completed until the lug 14*b* bottoms out in the oversized channel 18*b*, which is usually contemporaneous with an annular seating surface 18*f* on the proximal end of the connector 18 engaging a corresponding annular seating ledge 14*c* on the receiver 14 (and most preferably such that a substantially airtight connection is established to prevent any loss of suction and/or the escape of dirt or dust flowing through the tubular passageway thus formed). An annular lip 14*d* at the distal end of the receiver 14 may also seat in a cavity 18*g* formed in the interior of the connector 18 to also provide an airtight seal (see FIGS. 5*a* and 5*b*). In both cases, the engagement of the various surfaces of the nested receiver 14 and connector 18 is such that relative rotation is in no way hampered.

In this mated condition, the positioning of the groove 16 is such that it is at least partially exposed to view by the slot 20, as is the associated center rib 16*a*. Preferably, the positioning is such that the rib 16*a* is centered within the slot 20. If such is initially not the case, then it is of course possible to rotate the receiver 14 and connector 16 relative to each other, with the lug 14*b* freely moving to and fro within the channel 18*b* (see action arrow B in FIG. 3*a*) as necessary to center the rib 16*a* generally within the slot 20.

Figure 4:
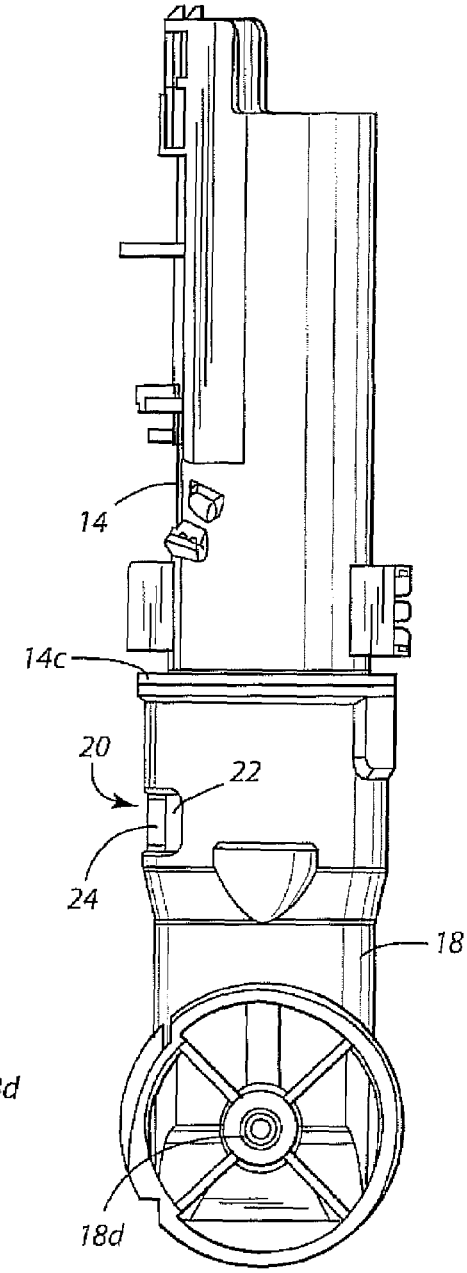
FIG. 4 is a side elevational view of the completed swivel assembly of FIG. 2.

With the center rib 16*a* exposed and generally centered, the locking clip 22 may then be inserted through the oversized slot 20 to engage the groove 16. In particular, the resilient mounting tabs 22*b*, 22*c* may be pinched together for insertion into the slot 20 and then released in a generally tangential direction to occupy the space at least partially created by the groove 16 and lying between the inner surface of connector 18 and the outer surface of the receiver 14 (see FIG. 5*b*). Gentle finger pressure on the lug 24 causes the resilient tabs 22*b*, 22*c* to flex and engage the mounting shoulders 16*b*, 16*c*, thereby capturing the clip 22 against rotational movement relative to the receiver 14. In this mounted position, the extension of the lug 24 in the radial direction is preferably such that it has a low profile and thus does not project beyond the outer surface of the connector 18 (see FIGS. 4 and 5*a*).

Positioning of the lug 24 in the slot 20 and the capturing of the clip 22 in the groove 16 restrains movement of the receiver 14 relative to the connector 18 to one direction (i.e., rotation). Specifically, the receiver 14 is permitted to rotate relative to the connector 18 about a longitudinal center axis thereof by virtue of the confinement of the lug 14*b* within the channel 18*b* and the lug 24 within the slot 24 (note action arrow C in FIG. 3). However, relative movement in a different direction, such as the longitudinal or transverse direction, is precluded by the secure locking engagement of the clip 22 in the groove 16. This ensures that the desired engagement and corresponding seals formed between the mating surfaces of the receiver 14 and connector 18 are maintained, and that suction leaks and escaping dust are advantageously avoided. Of course, aside from rotation, pivoting movement of the wand W when connected is afforded by the pivot point created between the transverse head 18*c* at the distal end of the connector 18 and the nozzle assembly N.

In the event it becomes necessary to release the coupling thus formed, this can be accomplished using a tool, such as a pair of pliers or grips, to remove the locking clip 22. Specifically, applying a tangential force to the resilient tabs 22*b*, 22*c* will release them from the engagement with the mounting shoulders 16*b*, 16*c*. The clip 22 can then simply be removed from the slot 20 by applying a force on the lug 24 in the radial direction away from the assembly 10, and the receiver 14 withdrawn from the connector 18.

In summary, numerous benefits result from employing the concepts of the present invention. Advantageously, through the use of the swivel assembly 10 and particularly the separate locking clip 22, it is possible to easily and efficiently couple the swivel connector 18 to the wand W via a receiver 14 while permitting limited relative rotational movement, but without the possibility of the user inadvertently decoupling the structures and causing an undesirable loss of suction. The simplicity of construction of the locking clip 22 and the manner in which in interfaces with the receiver 14 and swivel connector 18 minimizes the manufacturing expense and effort, without sacrificing the quality of the connection thus formed (and without losing the ability for relative rotation). Accordingly, a vacuum cleaner incorporating the swivel assembly 10 is less expensive to produce and maintain, and yet provides the desirable enhanced reliability and versatility in operation.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, while the vacuum cleaner illustrated and described in this document is a canister vacuum cleaner, it should be appreciated that the vacuum cleaner may just as easily be a hand-held or an upright vacuum cleaner and the present invention and claims are considered to be broad enough to be drawn thereto.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

The invention claimed is:

1. A swivel assembly for connecting a wand to a nozzle assembly of a vacuum cleaner, comprising:

a connector for pivotally connecting to the nozzle assembly, said connector including an oversized opening formed in an outer sidewall thereof;

a receiver for receiving the wand at a first end and for connecting with the connector at a second end; and a locking clip for connecting to the receiver and including a lug movably received in the opening, whereby movement of the lug within the opening permits the receiver to rotate relative to the connector while restraining separation of the receiver from the connector.

2. The swivel assembly according to claim 1, wherein a first end of the connector surrounds a portion of the receiver.

3. The swivel assembly according to claim 1, wherein the opening comprises an arcuate slot.

4. The swivel assembly according to claim 1, wherein the connector further includes a channel generally opposite the opening.

5. The swivel assembly according to claim 4, wherein the receiver includes a lug for positioning in the channel of the connector.

6. The swivel assembly according to claim 1, wherein the receiver includes a groove for receiving the locking clip.

7. The swivel assembly according to claim 6, wherein the groove includes a rib and a pair of mounting shoulders, one on either side of the rib.

8. The swivel assembly according to claim 7, wherein the locking clip includes a notch for receiving the rib.

9. The swivel assembly according to claim 8, wherein the locking clip further includes resilient tabs for engaging the mounting shoulders.

10. A swivel assembly for connecting a wand to a nozzle assembly of a vacuum cleaner, comprising:

a tubular connector for pivotally connecting to the nozzle assembly, said connector including a slot formed in an outer sidewall thereof and a channel generally opposite the slot;

a tubular receiver for receiving the wand and including a first lug movably received within the channel; and a locking clip including a second lug movably received in the slot;

whereby movement of the first lug within the channel and the second lug within the slot permits limited rotation of the receiver relative to the connector while resisting separation of the receiver from the connector.

11. The swivel assembly according to claim 10, wherein the slot and channel are arcuate and have generally matching degrees of curvature.

12. The swivel assembly according to claim 10, wherein the receiver includes a groove for receiving the locking clip.

13. The swivel assembly according to claim 12, wherein the groove includes a rib and a pair of mounting shoulders, one on either side of the rib.

14. The swivel assembly according to claim 13, wherein the locking clip includes a notch for receiving the rib.

15. The swivel assembly according to claim 13, wherein the locking clip further includes resilient tabs for engaging the mounting shoulders.

16. A swivel assembly for connecting a wand to a nozzle assembly of a vacuum cleaner, comprising:

a tubular connector for connecting to the nozzle assembly, said connector including a slot formed in an outer sidewall thereof;

a locking clip including a lug movably received in the slot; and a tubular receiver for receiving the wand and including a groove for receiving the locking clip;

whereby movement of the lug within the slot permits limited rotation of the receiver relative to the connector while the locking clip when positioned in the groove resists separation of the receiver from the connector.

17. The swivel assembly according to claim 16, wherein the tubular connector includes a transverse head forming a pivot point for pivotally connecting to the nozzle assembly.

18. The swivel assembly according to claim 16, wherein the groove includes a rib and a pair of mounting shoulders, one on either side of the rib.

19. The swivel assembly according to claim 18, wherein the locking clip includes a notch for receiving the rib.

20. The swivel assembly according to claim 18, wherein the locking clip includes resilient tabs for engaging the mounting shoulders.

21. A method of connecting a wand to a nozzle assembly of a vacuum cleaner, comprising:

pivotally connecting a connector including an oversized opening formed in an outer sidewall thereof to the nozzle assembly;

connecting the wand at a first end of a receiver;

connecting the connector at a second end of the receiver; and associating a locking clip with the assembled connector and receiver, the locking clip including a lug movably received in the opening formed in the connector;

whereby movement of the lug within the opening permits limited rotation of the receiver relative to the connector while restraining separation of the receiver from the connector.

22. The method of claim 21, wherein the locking clip is inserted through the opening.

23. The method of claim 21, further including the step of inserting a lug associated with the receiver in a oversized channel formed in the connector.

* * * * *